US006196475B1

(12) United States Patent
Jaeger

(10) Patent No.: US 6,196,475 B1
(45) Date of Patent: Mar. 6, 2001

(54) ROTOR NOZZLE

(76) Inventor: Anton Jaeger, Dorfstrasse 9, Senden-Hittistetten (DE), 89250

( * ) Notice: Subject to any disclaimer, the term of this patent is extended or adjusted under 35 U.S.C. 154(b) by 0 days.

(21) Appl. No.: 09/311,986

(22) Filed: May 14, 1999

(30) Foreign Application Priority Data

May 15, 1998 (DE) ..... 198 21 919

(51) Int. Cl.[7] ..... B05B 3/04
(52) U.S. Cl. ..... 239/381
(58) Field of Search ..... 239/380–383, 239/225.1, 251, 259, 237, 240, 242, 243

(56) References Cited

FOREIGN PATENT DOCUMENTS

4133973A1 4/1992 (DE) .

4340184A1 6/1995 (DE) .

*Primary Examiner*—Andres Kashnikow
*Assistant Examiner*—Jorge S. Bocanegra
(74) *Attorney, Agent, or Firm*—Townsend and Townsend and Crew LLP

(57) ABSTRACT

The invention relates to a rotor nozzle, in particular for high pressure cleaning aggregates, comprising a nozzle housing having at its axial end an inlet opening and an outlet opening at the other end for the cleaning liquid, and comprising a rotor which is arranged in the nozzle housing so as to be inclined with respect to its longitudinal axis, which is rotationally driven, which is supported at the housing inner wall and which is provided at its end which points to the outlet opening with a nozzle which is supported in a pan bearing and which has an inflow opening which is formed in a connection member at the opposite end, with the connection member being connected to the nozzle housing such that it is sealed off and axially displaceable and carrying at its end facing the rotor a funnel-shaped fixing element for the centered holding of the rotor.

22 Claims, 4 Drawing Sheets

ROTOR NOZZLE

BACKGROUND OF THE INVENTION

The invention relates to a rotor nozzle.

A rotor nozzle of this kind is known from DE 43 40 184 A1 and is used in particular in high pressure cleaning aggregates. In the known rotor nozzle the pan bearing can be displaced in the axial direction via a setting sleeve which surrounds the nozzle housing.

SUMMARY OF THE INVENTION

The problem (object) on which the invention is based is to create a rotor nozzle of the initially named kind which is simply constructed and easy to operate.

In accordance with the invention the connection member is connected to the nozzle housing such that it is sealed off and axially displaceable; and the connection member carries at its end facing the rotor a funnel-shaped fixing element for the centered holding of the rotor.

The connection member of the rotor nozzle in accordance with the invention consequently serves not only for the connection of the rotor nozzle to the infeed line for the cleaning liquid, but serves at the same time as a carrier for the fixing element. The construction of the rotor nozzle can thereby be kept very simple. In addition the rotor nozzle in accordance with the invention is distinguished by an ease of operation, since a user, who in practice mainly holds the rotor nozzle via a bar which is rotationally fixedly connected to the connection member and which forms the end piece of the infeed line, need merely move the nozzle housing axially relative to the connection member in order to change between a conical jet and a point or straight jet operation.

Moreover, through the invention the radial dimensions of the rotor nozzle can be kept small since the radial dimensions are determined only by the nozzle housing. As a result a compact and slender object is created with the invention with which it is also possible to work in restricted spaces and at poorly accessible locations.

Advantageous embodiments of the invention are described in the description, in the drawings and in the subordinate claims.

A particularly simple construction results when in accordance with a preferred embodiment of the invention the fixing element is designed in a single piece with the connection member. Here, with the connection member only a single component is required, through the axial movement of which relative to the nozzle housing a displacement of the fixing element is directly enabled.

It is particularly advantageous in accordance with a further embodiment of the invention when the connection member and the nozzle housing are screwed to one another so that the desired position of the fixing element can be achieved through a simple rotation of the nozzle housing relative to the connection member.

In accordance with a further embodiment the connection member comprises a carrier which is firmly connected to the nozzle housing, at which the fixing element is axially movably journalled and to which a connection ring is axially displaceably connected, with the connection ring cooperating with the fixing element via at least one slider element which is preferably designed to be pin-like.

This embodiment has the advantage that in addition to the connection ring no further components need be rotatably journalled.

In accordance with a further preferred embodiment the screw connection between the connection member and the nozzle housing or between the carrier and the connection ring respectively has a large thread pitch, through which the rotor nozzle in accordance with the invention can be reset rapidly and in particular with a single hand movement.

DESCRIPTION OF THE SPECIFIC EMBODIMENTS

Figure 1A:
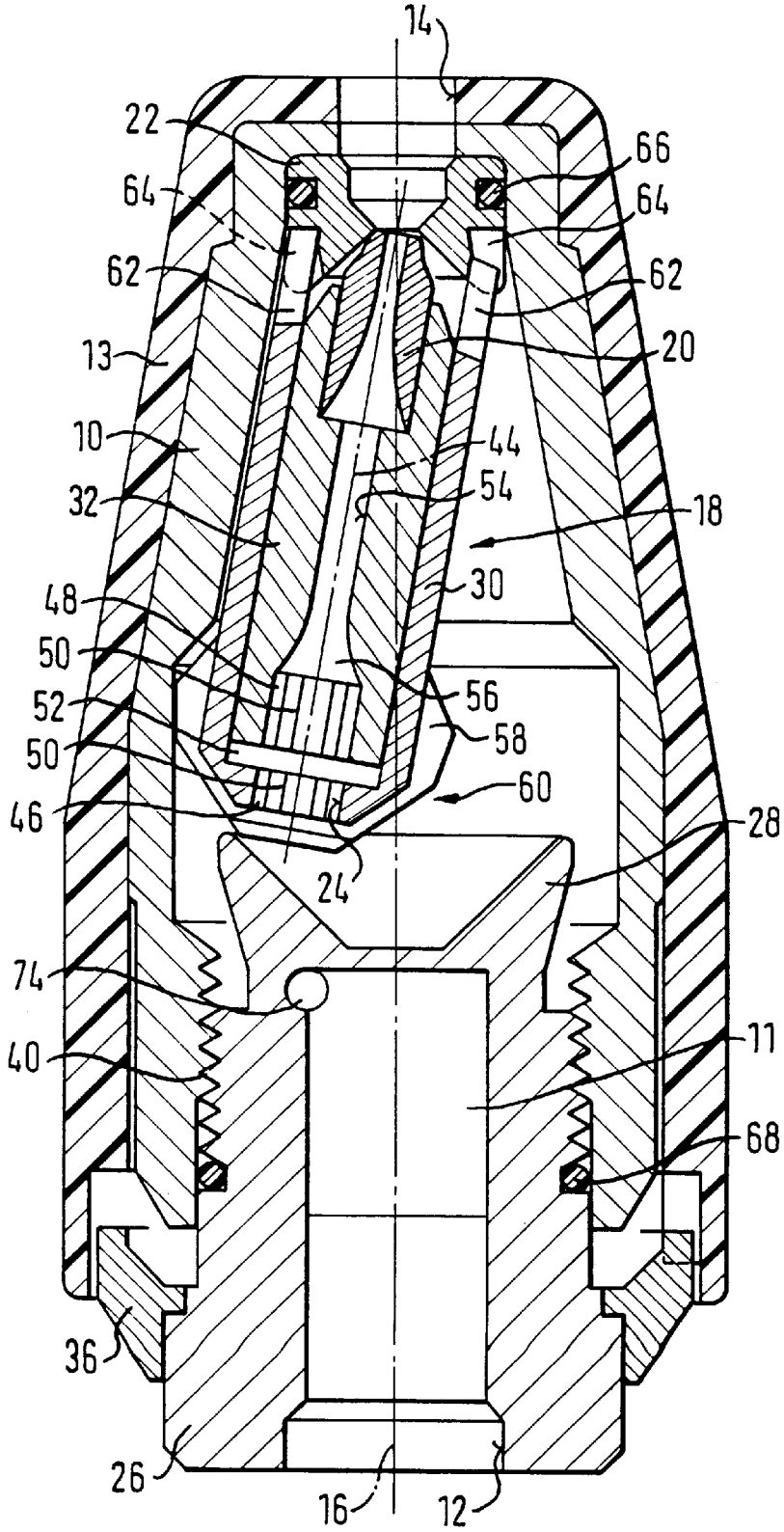
FIG. 1*a* is an axial section of a first embodiment of a rotor nozzle in accordance with the invention with freely rotatable rotor.
Figure 1B:
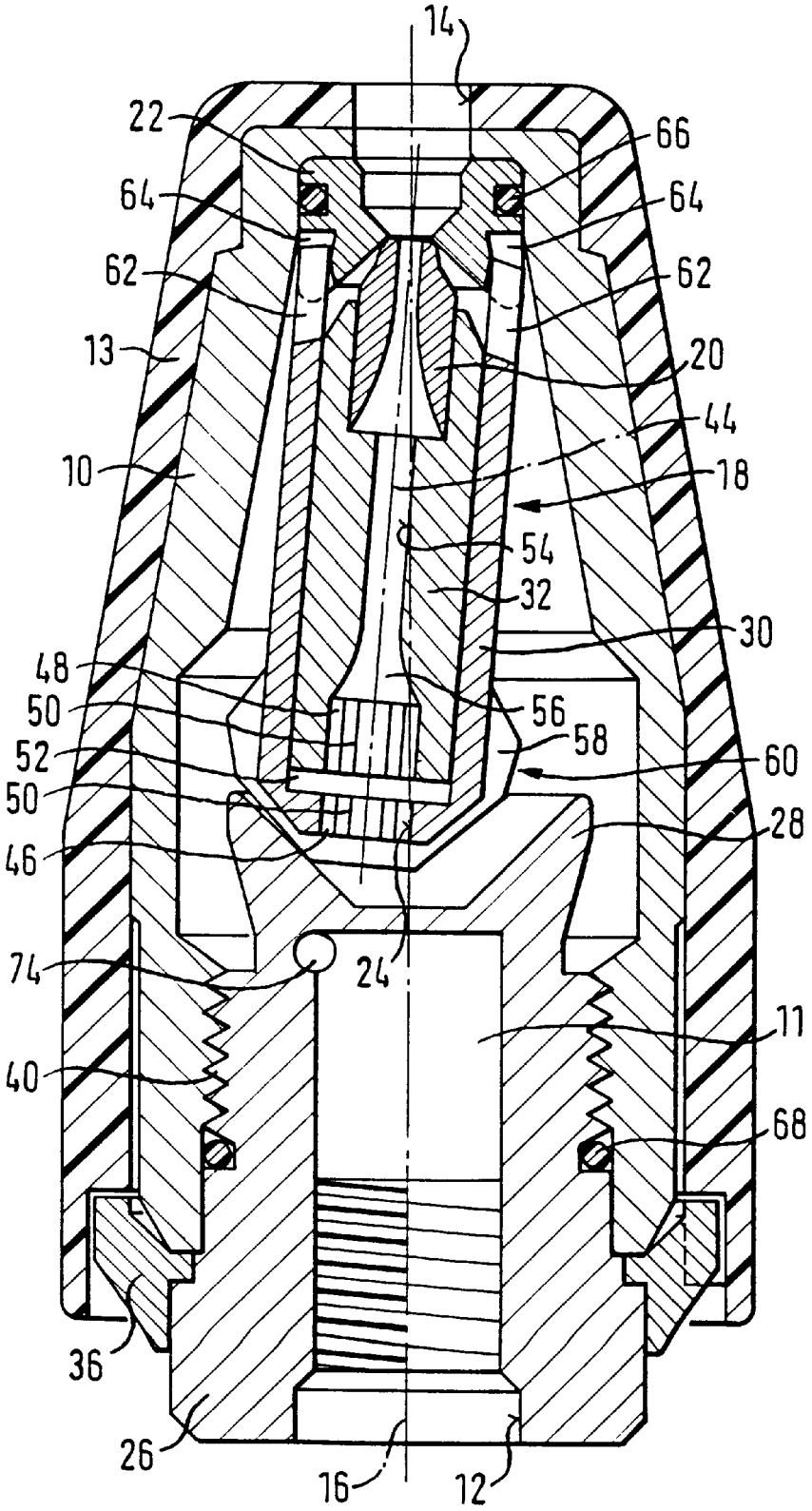
FIG. 1*b* is a view corresponding to FIG. 1*a* with the rotor fixed.

The rotor nozzle in accordance with a first embodiment of the invention as shown in FIGS. 1*a* and 1*b* comprises an approximately cylindrical nozzle housing 10 which contracts in the forward region and which is surrounded by an outer jacketing 13 which consists in particular of an elastic material.

In the region of the outlet opening 14 a funnel-shaped pan bearing 22 for a rotor 18 is arranged which is formed with an inner surface which extends at an inclination to the longitudinal axis 16 of the nozzle housing 10.

A connection member 26 which runs on a thread 40 and which is formed in a single piece with a fixing element 28 for the rotor 18 is screwed into the nozzle housing 10 at the connection side, i.e. at the opposite or upstream end of the rotor nozzle. The fixing element 28 is designed in the shape of a funnel and has an inner surface which extends at an inclination to the longitudinal axis 16 of the nozzle housing 10 and a base surface which extends perpendicular to the longitudinal axis 16 of the nozzle housing 10.

The thread 40 of the screw connection between the nozzle housing 10 and the connection member 26 preferably has such a large thread pitch that a comparatively large axial relative movement between the nozzle housing 10 and the connection member 26 is achieved with a small rotation angle.

An approximately cylindrical inlet space 11 which is formed in the connection member 26 communicates with at least one radial bore 74 through which liquid, in particular water, flows in during operation in the radial direction into the rotation space which is bounded by the nozzle housing 10, the pan bearing 22 and the fixing element 28.

Outside the nozzle housing 10 the connection member 26 is provided with a ring attachment 36 which lies in contact at a shoulder of the outer jacketing 13 as well as at the end side of the nozzle housing 10 when the connection member 26 is located in its position in accordance with FIG. 1*b*.

O-rings 66, 68 seal off the rotation space outwardly with respect to the pan bearing 22 and the connection member 26 respectively.

The rotor 18 comprises a cylindrical outer sleeve 30, in which an inner body 32 is arranged in which a through-flow passage 56 which defines the longitudinal axis 44 of the rotor 18 is formed which has a constriction 54 and at which a nozzle 20 adjoins, which is supported at the pan bearing 22.

In the region of an inflow opening 24 of the rotor 18 the through-flow passage 56 is formed as a double rectifier which comprises a pre-rectifier which forms a shorter rectifier path 46 and a main rectifier which forms a longer rectifier path 48, between which a calming path 52 is provided which is dimensioned shorter than the rectifier paths 46, 48, which is preferably about between 2 and 4 mm in length and the cross-sectional area of which is greater than that of each of the rectifier paths 46, 48. In the region of the rectifier paths 46, 48 the inner wall of the inner body 32 which bounds the through-flow passage 56 is provided with longitudinal ribs 50.

At its end facing the fixing element 28 the rotor 18 is provided with a roller body 60 by means of which the rotor 18 rolls along the inner wall of the nozzle housing 10 in the position in accordance with FIG. 1*a*. Flow passages are formed in the roller body 60 which extend upstream at first approximately at the same angle to the longitudinal axis 44 of the rotor 18 as the inclined surface of the fixing element 28 to the longitudinal axis 16 of the nozzle housing 10. Afterwards the flow passages merge into a downstream region which extends approximately parallel to the longitudinal axis 44 of the rotor 18. In this region the roller body 60 has, as a result of the execution of the flow passages, vanes 58 which are distributedly arranged in the peripheral direction of the rotor 18 and which project approximately perpendicularly from the outer sleeve 30. The flow passages are preferably formed as grooves which are milled into the roller body 60.

At its end facing the pan bearing 22 the outer sleeve 30 of the rotor 18 has two projecting holder arms 62. The ends of the holder arms 62 engage into cut-outs 64 which are formed in the pan bearing 22.

In the operation of the rotor nozzle in accordance with the invention there arise, as a result of the water flowing through the bore 74 in the radial direction, water turbulences in the rotation space which cooperate with the vanes 58 of the rotor 18 and set the rotor into rotation in the position in accordance with FIG. 1*a*. The connection member 26 is screwed out of the nozzle housing 10 to such an extent that in this situation the rotor 18 with its roller body 60 rolls along the inner wall of the nozzle housing 10.

The water flows via the inflow opening 24 into the through-flow passage 56, via which it arrives into the nozzle 20 and emerges via the outlet opening 14 out of the rotor nozzle in the form of a conical jet.

The longitudinal ribs 50 of the two rectifier paths 46, 48 and the calming path 52 which is arranged between them ensure that the water which flows into the rotor 18 is calmed, i.e. the rotational movement of the water is reduced.

The constriction 54 in the through-flow passage 56 of the rotor 18 ensures that the rotor 18 is pressed by the inflowing water against the pan bearing 22.

The holder arms 62 of the rotor 18, which engage in a fork-like manner into the cut-outs 64 which are formed at the sides of the pan bearing 22, prevent a rotation of the rotor 18 about its own longitudinal axis 44.

In order to change from the conical jet operation in accordance with FIG. 1*a* to a point or straight jet operation the connection member 26 is rotated relative to the nozzle housing 10, through which the rotating rotor 18 is captured by the funnel-shaped fixing element 28 and is centeringly held firmly in the final position of the connection member 26 in accordance with FIG. 1*b*.

A sucking action, which arises when the fixing element 28 approaches the rotor 18, and which attempts to draw the rotor 18 out of the pan bearing 22, is prevented by the flow passages which are formed in the roller body 60 of the rotor 18.

In practice, the connection member 26 is mainly rotationally fixedly connected to a holder bar which forms the end piece of the infeed line. For switching over between conical and straight jet operation the user, who holds the holder bar firmly with one hand, can therefore simply rotate the nozzle housing with his other hand. As a result of the preferred large thread pitch this is possible with a single hand movement only and without changing the grip.

In the embodiment in accordance with FIGS. 1*a* and 1*b* the rotor nozzle is designed in such a manner that in the position in accordance with FIG. 1*b* the rotor 18 can still be deflected slightly out of its zero position, in which its longitudinal axis 44 extends parallel to the longitudinal axis 16 of the nozzle housing 10, and indeed preferably up to an angle of inclination of a maximum of about 5° with respect to the longitudinal axis 16 of the nozzle housing 10.

It is however also possible to execute the rotor nozzle in such a manner that the connection member 26 can be screwed further into the nozzle housing 10 and the rotor 18 can be centered in a zero position.

The embodiments of the rotor nozzle in accordance with the invention in accordance with FIGS. 2 and 3 which will be explained in the following corresponding with respect to construction, method of operation and advantageous effects to the above exemplary embodiment which is described above with reference to FIGS. 1*a* and 1*b* with the exception of the deviations which will be explained in the following.

Figure 2:
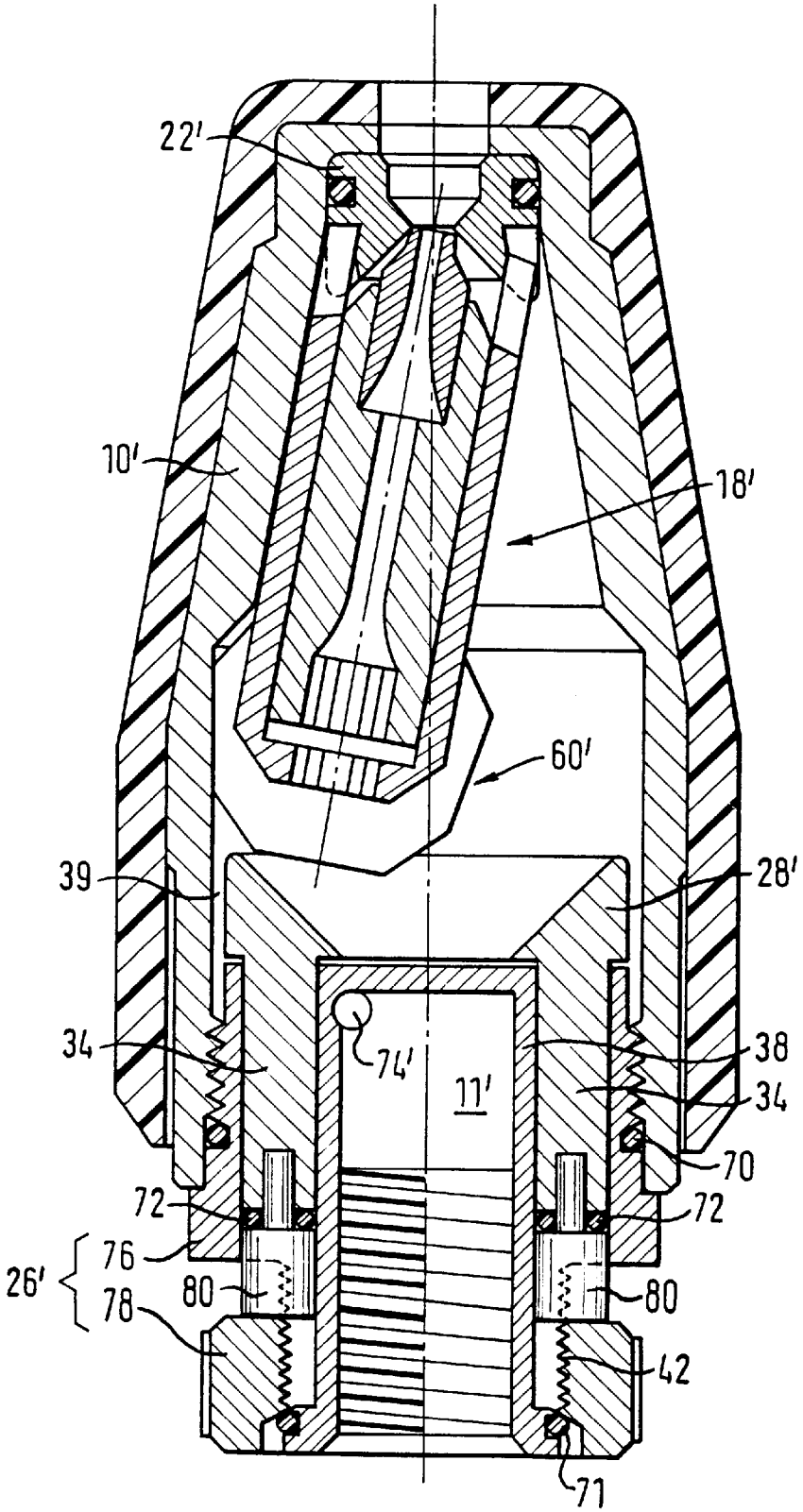
FIG. 2 is an axial section of a second embodiment of a rotor nozzle in accordance with the invention.

In accordance with FIG. 2 the connection member 26' comprises a carrier 76 which is firmly connected to the nozzle housing 10' and a connection ring 78 which is screwed onto a section of the carrier 76 which protrudes out of the nozzle housing 10' and which runs on a thread 42. Corresponding to the thread 40 of the first embodiment (FIGS. 1*a* and 1*b*) the thread 42 also preferably has a large thread pitch so that a large axial displacement path of the fixing element 28' can be achieved with small angles of rotation.

An O-ring 70 which is arranged between the carrier 76 and the nozzle housing 10' seals off the rotation space of the rotor nozzle to the outside, whereas an O-ring 71 provides for a sealing between the connection ring 78 and the carrier 76.

The carrier 76 has an inner pot-shaped section 38 which bounds an inlet space 11' which communicates via a radial bore 74' with the rotation space.

The fixing element 28' is axially movably journalled by means of two pin-like extensions 34 at the connection side, and indeed between a wall of the carrier 76 facing the inner wall of the nozzle housing 10' and the outer wall of the pot-shaped section 38 of the carrier 76. The extensions 34 of the fixing element 28' can also be formed as separate slider pins.

The extensions 34 of the fixing element 28' cooperate via pin-like slider elements 80, which preferably consist of metal, with the connection ring 78 of the connection member 26' in such a manner that through a rotation of the nozzle housing 10' and connection ring 78 the slider elements 80 are pushed forwards, through which the fixing element 28' is displaced in the direction of the pan bearing 22' and centeringly holds the rotor 18' firmly in its final position.

If the connection ring 78 is rotated back into the position in accordance with FIG. 2 for a conical jet operation, the water pressure in the rotation space and the rotor 18', which set into rotation by the water turbulences and presses towards the inner wall of the nozzle housing 10', provide for the fixing element 28'—and via its extensions 34 thereby also the slider element 80—being pushed back into its position shown in FIG. 2. In this position, shoulders which are formed at the fixing element 28' lie in contact at the end side of the carrier 76 which points towards the rotor 18'.

During the operation of the rotor nozzle in accordance with FIG. 2 the water flows via the inlet space 11' and the bore 74' in the radial direction to an intermediate space 39 between the outer wall of the fixing element 28' and the inner wall of the nozzle housing 10' and from there into the rotation space and into the rotor 18'.

The sealing off in the region of the slider elements 80 takes place through O-rings 72 which are laid around extensions of the slider elements 80 and which fit into corresponding cut-outs of the extensions 34 of the fixing element 28'.

The rotor 18' in accordance with FIG. 2 differs from the rotor of the embodiment in accordance with FIGS. 1*a* and 1*b* through a roller body 60' which is axially prolonged in the direction of the fixing element 28'. The peripheral surface of the roller body 60', with which the rotor 18' rolls along the inner wall of the nozzle housing 10' in the conical jet operation in accordance with FIG. 2, is thereby enlarged with respect to the corresponding peripheral surface of the roller body of the embodiment in accordance with FIGS. 1*a* and 1*b*.

Figure 3:
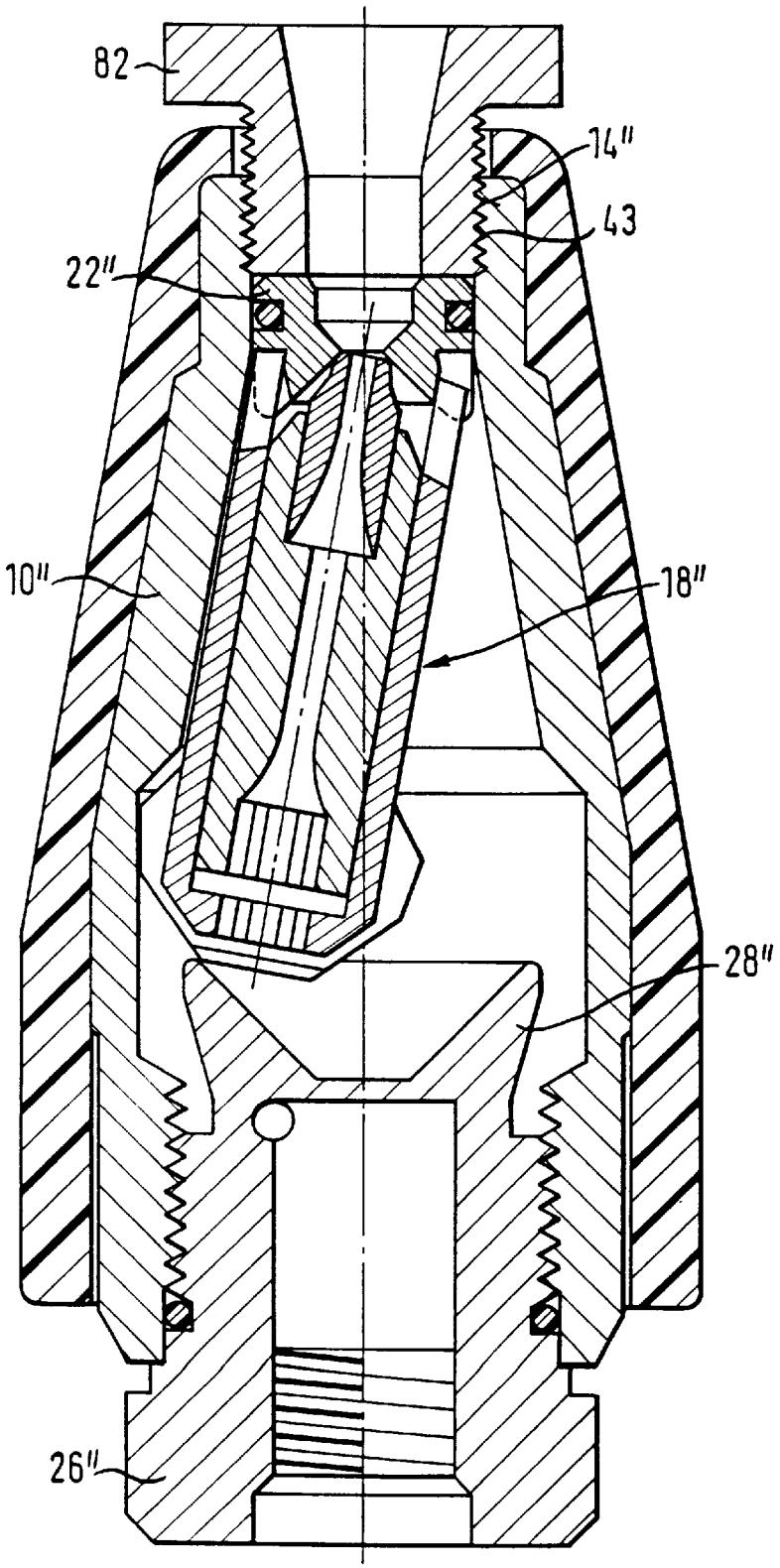
FIG. 3 is an axial section of a third embodiment of a rotor nozzle in accordance with the invention.

In the embodiment in accordance with FIG. 3 the fixing element 28" is axially stationarily formed at a connection member 26" which is firmly connected to the nozzle housing 10".

The switching over between a conical jet operation in accordance with FIG. 3 and a straight jet operation takes place here through axial displacement of the pan bearing 22", which is coupled to a setting member 82 which is screwed into the outlet opening 14" of the nozzle housing 10".

In order to change from the conical jet operation in accordance with FIG. 3 into the straight jet operation the setting member 82 is screwed into the nozzle housing 10", through which the connection-side end of the rotor 18" is captured by the fixing element 28". When the setting member 82 is rotated back again, the rotor 18", which is pressed against the pan bearing 22" by the water pressure, provides for the pan bearing 22" being pushed forwards against the end side of the setting member 82 facing it into the position in accordance with FIG. 3.

The thread 43 of the screw connection between the setting member 82 and the nozzle housing 10" also preferably has a large thread pitch corresponding to the threads 40, 42 of the first two embodiments described.

As is shown by the comparison of FIG. 1*a*, FIG. 2 and FIG. 3, the rotor nozzle in accordance with the invention is designed in all three embodiments in such a manner that during the conical jet operation only a small intermediate space remains between the fixing element and the end side of the roller body facing the fixing element.

What is claimed is:

1. A rotor nozzle comprising:

a nozzle housing having a longitudinal axis and an inner wall, the nozzle housing including at a first axial end an outlet opening and at a second axial end a connection member having an inlet opening;

a pan bearing disposed in the nozzle housing adjacent the outlet opening; and a rotor disposed in the nozzle housing and being inclined relative to the longitudinal axis of the nozzle housing, the rotor including a nozzle at a front end which points toward the outlet opening of the nozzle housing and is supported in the pan bearing, the rotor including an inflow opening at a rear end opposite from the nozzle, the rotor being rotatable in the nozzle housing and supported by the inner wall of the rotor housing with the rotor being inclined relative to the longitudinal axis of the nozzle housing by an angle of inclination in an inclined position to produce a conical jet, wherein the connection member is sealingly connected to the nozzle housing at the second axial end, the connection member including a fixing element with a funnel-shaped cavity including a slanted wall surface widows toward and facing the rear end of the rotor, wherein the connection member has an inlet space formed therein, the inlet space having an inlet opening, wherein the connection member has at least one bore formed therein as a flow connection between the inlet space and an interior of the nozzle housing, wherein the connection member is configured to couple an infeed line for liquid to the inlet opening of the connection member such that the liquid flows via the infeed line into the inlet space of the connection member and via the inlet space and the bore into the interior of the nozzle housing in order to set the rotor into rotation, wherein the connection member is axially displaceable relative to the nozzle housing to move toward the rotor in one direction to contact the rear end of the rotor and center the rotor with the slanted wall surface of the funnel-shaped cavity in a centered position to produce a straight jet, and wherein the connection member is axially displaceable relative to the nozzle housing to move away from the rotor in another direction to permit movement of the rotor toward the inclined position, the angle of inclination varying with axial displacement of the connection member relative to the nozzle housing.

2. The rotor nozzle of claim 1 wherein the rotor is inclined relative to the longitudinal axis of the nozzle housing by an angle of inclination having a maximum of about 5° when the rotor is in the centered position.

3. The rotor nozzle of claim 1 wherein the fixing element is integrally formed with the connection member as a single piece.

4. The rotor nozzle of claim 1 wherein the connection member is threadingly coupled to the nozzle housing at the second axial end.

5. The rotor nozzle of claim 4 wherein the connection member is threadingly coupled to the nozzle housing with a large thread pitch.

6. The rotor nozzle of claim 5 wherein the connection member is axially displaceable relative to the nozzle housing by a maximum axial displacement, and wherein rotation of the connection member relative to the nozzle housing by about 360° or less corresponds to the maximum axial displacement.

7. The rotor nozzle of claim 1 wherein the connection member comprises a carrier which is firmly connected to the nozzle housing and a connection ring which is axially displaceably connected to the carrier, the fixing element cooperating with the connection ring to be axially displaceably journalled with respect to the carrier.

8. The rotor nozzle of claim 7 wherein the fixing element is coupled with the connection ring via at least one slider element.

9. The rotor nozzle of claim 8 wherein the slide element is a pin-like element oriented in a direction of the longitudinal axis.

10. The rotor nozzle of claim 1 wherein the connection ring is threadingly coupled to the carrier.

11. The rotor nozzle of claim 10 wherein the connection ring is threadingly coupled to the carrier with a large thread pitch.

12. The rotor nozzle of claim 11 wherein the connection ring is axially displaceable relative to the carrier by a maximum axial displacement, and wherein rotation of the connection ring relative to the carrier by about 360° or less corresponds to the maximum axial displacement.

13. A rotor nozzle comprising:

a nozzle housing having a longitudinal axis and an inner wall, the nozzle housing including at a first axial end an outlet opening and at a second axial end a connection member having an inlet opening:

a pan bearing disposed in the nozzle housing adjacent the outlet opening; and a rotor disposed in the nozzle housing and being inclined relative to the longitudinal axis of the nozzle housing, the rotor including a nozzle at an end which points toward the outlet opening of the nozzle housing and is supported in the pan bearing, the rotor including an inflow opening at another end opposite from the nozzle, the rotor being rotatable in the nozzle housing and supported by the inner wall of the rotor housing, wherein the connection member is sealingly connected to the nozzle housing at the second axial end and is axially displaceable relative to the nozzle housing, the connection member including a fixing element with a funnel-shaped cavity facing the rotor, wherein the rotor includes a rectifier arrangement at the end toward the inflow opening.

14. The rotor nozzle of claim 13 wherein the rectifier arrangement comprises a double rectifier having at least two rectifier paths and at least one calming path disposed therebetween.

15. The rotor nozzle of claim 14 wherein the at least two rectifier paths have different lengths.

16. The rotor nozzle of claim 14 wherein the calming path is shorter than each of the at least two rectifier paths.

17. The rotor nozzle of claim 14 wherein the calming path has a length of about 2 to 4 mm.

18. The rotor nozzle of claim 14 wherein the calming path has a cross section which is larger in area than cross sections of the at least two rectifier paths.

19. The rotor nozzle of claim 1 wherein the rotor includes at outer sides a plurality of flow passages at least in a region of the end at which the inflow opening is disposed.

20. A rotor nozzle comprising:

a nozzle housing having a longitudinal axis and an inner wall, the nozzle housing including at a first axial end an outlet opening and at a second axial end a connection member having an inlet opening;

a pan bearing disposed in the nozzle housing adjacent the outlet opening; and a rotor disposed in the nozzle housing and being inclined relative to the longitudinal axis of the nozzle housing, the rotor including a nozzle at an end which points toward the outlet opening of the nozzle housing and is supported in the pan bearing, the rotor including an inflow opening at another end opposite from the nozzle, the rotor being rotatable in the nozzle housing and supported by the inner wall of the rotor housing, wherein the connection member is sealingly connected to the nozzle housing at the second axial end and is axially displaceable relative to the nozzle housing, the connection member including a fixing element with a funnel-shaped cavity facing the rotor, wherein the rotor includes at outer sides a plurality of flow passages at least in a region of the end at which the inflow opening is disposed, wherein the flow passages comprise grooves formed in the rotor or in a roller body connected to the rotor.

21. The rotor nozzle of claim 1 wherein the rotor includes a rotational securing member to prevent rotation of the rotor around a longitudinal axis of the rotor.

22. The rotor nozzle of claim 21 wherein the rotational securing member comprises at least one holder arm projecting from the rotor in a direction toward the outlet opening, the at least one holder arm engaging into a cut-out formed in a region of the pan bearing.

* * * * *